US006417775B1

(12) United States Patent
Culler et al.

(10) Patent No.: US 6,417,775 B1
(45) Date of Patent: Jul. 9, 2002

(54) METHODS AND SYSTEMS FOR MONITORING LIGHTING CONTROL AND INDICATING FAILURE

(75) Inventors: Mark F. Culler, Glastonbury, CT (US); Alexander E. Paris, Bowmanville; Barry D. Ferg, North Vancouver, both of (CA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/611,871

(22) Filed: Jul. 7, 2000

(51) Int. Cl.[7] ..... G08B 21/00

(52) U.S. Cl. ..... 340/635; 340/625; 340/638; 340/815.47

(58) Field of Search ..... 340/524, 525, 340/507, 652, 815.65, 815.47, 635, 638, 644, 502, 503, 504

(56) References Cited

U.S. PATENT DOCUMENTS 3,529,292 A * 9/1970 Neil et al. ..... 340/163
4,392,187 A * 7/1983 Bornhorst ..... 362/233
4,920,476 A * 4/1990 Brodsky et al. ..... 364/140
5,367,427 A * 11/1994 Matsko et al. ..... 361/94
5,451,879 A * 9/1995 Moore ..... 324/418
5,909,180 A * 6/1999 Bailey et al. ..... 340/639
5,945,993 A * 8/1999 Fleischmann ..... 345/339
6,046,550 A * 4/2000 Ference et al. ..... 315/291
6,067,023 A * 5/2000 Bendikas ..... 340/638
6,112,127 A * 8/2000 Bennett ..... 700/86
6,157,527 A * 12/2000 Spencer et al. ..... 361/64
6,172,432 B1 * 1/2001 Schnackenberg et al. ..... 307/23

* cited by examiner

*Primary Examiner*—Jeffery Hofsass
*Assistant Examiner*—Phung T Nguyen
(74) *Attorney, Agent, or Firm*—Damian G. Wasserbauer, Esq.; Armstrong Teasdale, LLP

(57) ABSTRACT

A method and system for monitoring relay status using a lighting control panel is disclosed. The lighting control panel is used, for example, to control lighting throughout a building. The method includes the steps of commanding at least one relay to an on or off position from the lighting control panel, monitoring the status of the at least one relay from the lighting control panel, and setting the state of an indicator on the lighting control panel to show relay OFF, relay ON, or relay failed based on a monitored relay status.

20 Claims, 1 Drawing Sheet

METHODS AND SYSTEMS FOR MONITORING LIGHTING CONTROL AND INDICATING FAILURE

BACKGROUND OF THE INVENTION

This invention relates generally to microprocessor control and monitoring of circuits and more specifically to a microprocessor controlled lighting system.

In many buildings lighting is controlled from one central location using a lighting control panel which uses a large number of relay circuits to switch off and on a number of lighting fixtures throughout a building. LEDs or other indicators are used on the lighting control panel to indicate whether or not the relay was last switched on or off. However determination of the failure of a relay is an extensively manual process. A person must either check the relay outputs electrically or manually check the lighting in a location to determine whether or not the state of the lighting fixture matches the LED on the lighting control panel. In addition, knowledge of which lights are wired to which relay is required. It would be desirable to monitor the state of lighting in a building in a way that did not require manual verification that the relay is working or knowledge of which lights are wired to which relay.

BRIEF SUMMARY OF THE INVENTION

A lighting control panel is used, for example, to control lighting throughout a building. A method and system for monitoring relay status ON or OFF position from the lighting control panel includes monitoring the status of at least one relay from the lighting control panel. The state of an indicator on the lighting control panel is set to show if the relay commanded position matches the relay monitored position.

DETAILED DESCRIPTION OF THE INVENTION

Figure 1:
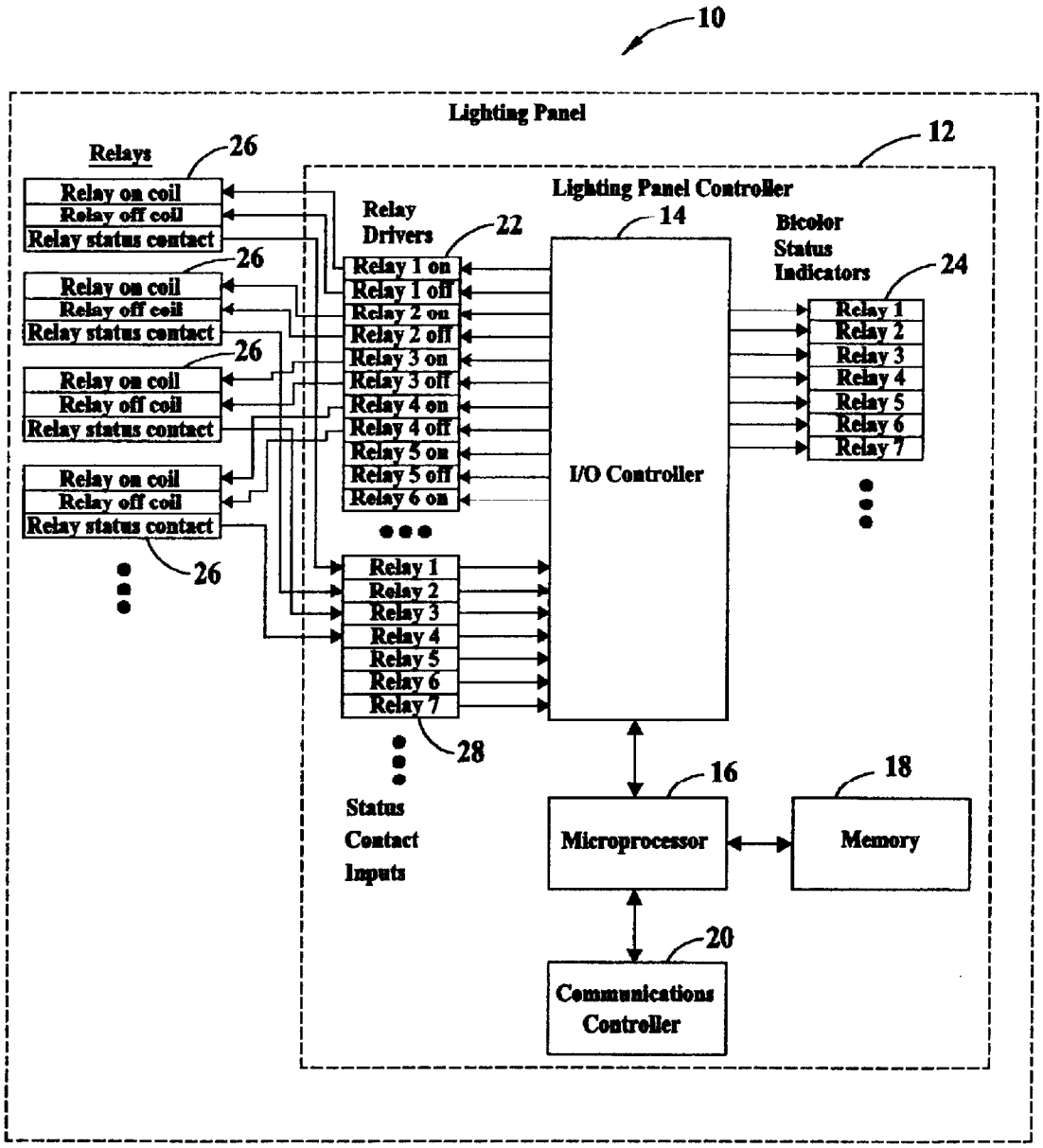
FIG. 1 is a diagram of an exemplary embodiment of a lighting panel.

Lighting control panels are used to control lighting throughout buildings or other structures. FIG. 1 is a diagram of an exemplary embodiment of a lighting panel 10. Included in lighting panel 10, is a lighting panel controller 12 including an input/output (I/O) controller 14, microprocessor 16, memory 18, communications controller 20, relay drivers 22 used to energize relay coils, and status indicators 24. A lighting control program, stored in memory 18 and executed by microprocessor 16 commands I/O controller 14 to turn on or turn off individual relays 26 or a group of relays 26 using relay drivers 22. Relays 26 include relay status contacts, which are mechanical switches that change state due to a mechanical connection to a wiper arm of relay 26. Relay status contacts provide a signal to I/O controller 14 using status contact inputs 28, the signal signifying a status of relay 26. Microprocessor 16 is further configured to read the status of the relays at status contact inputs 28, and to compare the status read by microprocessor 16 to the commands previously sent to I/O controller 14, and set status indicators 24 to a state which shows which, if any, relay status reads do not match I/O controller commands.

In one embodiment, status indicators 24 are bi-color LEDs which are illuminated to one color to signify relay on, and not illuminated to signify relay off. A second color of the bi-color LEDs is used, for example to indicate when relay status reads do not match I/O controller 14 commands from microprocessor 16. An operator using lighting panel controller 12 to control a lighting application is thereby able to verify whether the commanded relay condition matches the relay condition read at I/O controller 14. Commanded relay position is shown by the position of a mechanical switch (not shown) on lighting panel controller 12, communicated to microprocessor 16 via communication controller 20, or by other indicators controlled by microprocessor 16. If the commanded relay positions and relay status read positions do not agree, it is likely that a relay has failed. If a relay is identified as failed, it can be quickly checked and replaced if a failure has in fact occurred.

In another embodiment, when relays 26 are commanded on, a mechanical latching assembly within relay 26 will lock the relay on. For relay 26 to be turned off, a commanded off signal from I/O controller 14 is used to unlock the mechanical latching assembly and allow the relay to go to an OFF position.

Lighting panel 10 can be programmed with time intervals or a lighting schedule for automatic operation, or alternatively, lighting scenario commands can be sent to microprocessor 16 using communications controller 20 which provides an interface to external control devices (not shown) such as a network or an external computer for easy configuration.

The term microprocessor, as used herein, refers to microprocessors, microcontrollers, reduced instruction set circuits (RISC), application specific integrated circuits (ASIC), logic circuits, and any other circuit or processor capable of executing the program stored in memory 18.

While the invention has been described in terms of various specific embodiments, those skilled in the art will recognize that the invention can be practiced with modification within the spirit and scope of the claims.

What is claimed is:

1. A method for monitoring relay status using a lighting control panel, said method comprising the steps of:

commanding at least one relay to an on or off position from the lighting control panel;

monitoring the status of the at least one relay from the lighting control panel; and setting the state of an indicator on the lighting control panel to show if a commanded state of a relay matches a monitored relay status.

2. A method according to claim 1 wherein said step of commanding at least one relay to an on or off position further comprises the step of configuring a microprocessor to switch off and on the relays.

3. A method according to claim 2 wherein said step of configuring a microprocessor to switch off and on the relays further comprises the step of configuring a microprocessor to switch off and on the relays at preprogrammed time intervals or schedules.

4. A method according to claim 1 wherein said step of monitoring the status of the at least one relay further comprises the step of monitoring a relay status contact.

5. A method according to claim 4 wherein said step of monitoring a relay status contact further comprises the step of using an input/output controller to monitor a relay status contact.

6. A method according to claim 5 wherein said step of using an input/output controller to monitor a relay status contact further comprises the step of using a programmed microprocessor to monitor the input/output controller.

7. A method according to claim 1 wherein said step of setting the state of an indicator on the lighting control panel further comprises the step of illuminating an LED.

8. A method according to claim 7 wherein said step of illuminating an LED further comprises the steps of:

illuminating the LED to one color when a relay is commanded on; and illuminating the LED to another color when relay commanded status does not match relay monitored status.

9. A lighting panel controller comprising:

an input/output controller;

status indicators electrically connected to said input/output controller; and a microprocessor including a memory configured to control said input/output controller, said input/output controller configured to control and monitor a plurality of relays and electrically communicate with said status indicators such that said status indicators display the statuses of when each said respective relay is commanded to an on position and when relay commanded status does not match relay monitored status.

10. A lighting panel controller according to claim 9 further including a plurality of relay drivers electrically connected to said input/output controller.

11. A lighting panel controller according to claim 10 wherein said input/output controller is electrically connected to a plurality of relay status contacts used to indicate the state of a relay.

12. A lighting panel controller according to claim 9 wherein said status indicators indicate the monitored status of a relay.

13. A lighting panel controller according to claim 12 wherein said status indicators further comprise bi-color LEDs.

14. A lighting panel controller according to claim 9 wherein said microprocessor is further configured with a lighting schedule.

15. A lighting system comprising:

a plurality of lights;

a plurality of relays further comprising a plurality of electrical contacts electrically connected to the plurality of lights such that each relay controls the power to one or more lights; and a lighting panel controller configured to control and monitor the relays, said lighting panel controller configured with bi-color LEDs to indicate the status of each said respective relay, one color when a relay is commanded to an on state, the other color when relay commanded status does not match relay monitored status.

16. A lighting system according to claim 15 wherein said plurality of relays further comprise relay status contacts.

17. A lighting system according to claim 16 wherein said relay status contacts are configured to monitor the state of a said relay.

18. A lighting system according to claim 16 wherein said lighting panel controller is electrically connected to said relay status contacts to monitor a state of each said relay.

19. A lighting system according to claim 15 wherein said lighting panel controller is configured with relay drivers to control a state of each said relay.

20. A lighting system according to claim 15 wherein said lighting panel controller is configured with a lighting schedule.

* * * * *